US009003744B2

(12) United States Patent
Hannen

(10) Patent No.: US 9,003,744 B2
(45) Date of Patent: Apr. 14, 2015

(54) APPARATUS FOR PACKAGING AN OBJECT IN FILM

(75) Inventor: Reiner Hannen, Kalkar-Wissel (DE)

(73) Assignee: MSK-Verpackungs-Systeme GmbH, Kleve (DE)

( * ) Notice: Subject to any disclaimer, the term of this patent is extended or adjusted under 35 U.S.C. 154(b) by 758 days.

(21) Appl. No.: 13/320,465

(22) PCT Filed: Apr. 26, 2010

(86) PCT No.: PCT/EP2010/055497

§ 371 (c)(1),
(2), (4) Date: Jan. 10, 2012

(87) PCT Pub. No.: WO2010/130552

PCT Pub. Date: Nov. 18, 2010

(65) Prior Publication Data

US 2012/0096814 A1 Apr. 26, 2012

(51) Int. Cl.
*B65B 11/58* (2006.01)
*B65B 9/02* (2006.01)

(52) U.S. Cl.
CPC ..... *B65B 9/026* (2013.01); *B65B 11/585* (2013.01)

(58) Field of Classification Search
CPC B65B 11/58; B65B 11/585; B65B 2220/126; B65B 9/026; B65D 75/38
USPC ..... 53/449, 466, 170, 228, 176
See application file for complete search history.

(56) References Cited

U.S. PATENT DOCUMENTS

| | | | | | |
|---|---|---|---|---|---|
| 3,590,549 | A | * | 7/1971 | Zelnick | 53/442 |
| 3,640,048 | A | * | 2/1972 | Zelnick et al. | 53/442 |
| 3,672,116 | A | * | 6/1972 | Ingmarson | 53/397 |
| 3,896,604 | A | * | 7/1975 | Marantz | 53/176 |
| 3,994,114 | A | * | 11/1976 | Nishimura | 53/442 |
| 4,831,812 | A | * | 5/1989 | Martin Cocher et al. | 53/449 |
| 5,125,210 | A | | 6/1992 | Lang et al. | |
| 5,129,211 | A | * | 7/1992 | Andersson | 53/466 |
| 6,474,051 | B1 | | 11/2002 | Hannen et al. | |
| 6,532,719 | B2 | | 3/2003 | Hannen et al. | |
| 6,922,978 | B2 | * | 8/2005 | Gualchierani | 53/228 |

FOREIGN PATENT DOCUMENTS

| | | | | | |
|---|---|---|---|---|---|
| DE | 2448720 | A | * | 4/1975 | B65B 11/58 |
| DE | 2856849 | A | * | 7/1979 | B65B 11/58 |
| EP | 0183676 | B | | 7/1988 | |
| EP | 291858 | A2 | * | 11/1988 | B65B 11/585 |
| JP | 04352608 | A | * | 12/1992 | 53/228 |
| JP | 05229529 | A | * | 9/1993 | 53/228 |

* cited by examiner

*Primary Examiner* — Stephen F Gerrity
(74) *Attorney, Agent, or Firm* — Andrew Wilford

(57) ABSTRACT

An apparatus for packaging a load with film from a film supply has a first wrapping device that forms from the fed film a first film curtain that can be attached to all walls of the load. A folding device in the first wrapping device can fold a film section of the film fed from the film supply such that, after wrapping the load with the first film curtain, the film is attached to the side walls in a lower region of the side walls of the load in a double-layer manner according to the width of the folded film section. A second wrapping device forms from the fed film a second film curtain that the second wrapping device also attaches to the upper wall, to two side walls and to the bottom wall of the load.

12 Claims, 10 Drawing Sheets

APPARATUS FOR PACKAGING AN OBJECT IN FILM

CROSS REFERENCE TO RELATED APPLICATIONS

This application is the US-national stage of PCT application PCT/EP2010/055497 filed 26 Apr. 2010, published 18 Nov. 2010 as WO2010/130552, and claiming the priority of European patent application 09006445.2 itself filed 12 May 2009.

FIELD OF THE INVENTION

The invention relates to an apparatus for packaging a load with film. The invention furthermore also relates to a method of packaging a load with film. In the context of the invention, film refers in particular to a plastic film and preferably to an elastic plastic film. In the context of the invention, load refers in particular to a stack of goods that is accommodated on a pallet.

BACKGROUND OF THE INVENTION

Apparatuses and methods of the afore-mentioned type are known from practice in different embodiments. A known method initially relates to the pulling of a stretch film hood over a stack of goods or over a load, respectively. Typically, the film is fed here in the form of a side fold tube. In addition, it is known to shrink a shrink hood that is provided on the stack of goods, by using heat. Due to the side fold design of the film, many known methods use more film than necessary on the upper wall of the stack of goods. The film, which is fed in the form of a film tube, has the same thickness across its entire length and must thus be chosen to be sufficiently thick, so that highly-stressed locations of the load can be reinforced with it. An undesirably high amount of film material is used for this reason as well.

In addition, it is known to package a load with a stretch wrap film that typically consists of a highly elastic polyethylene film. The stretch wrap film is wound around in the load in a spiral-shaped manner. The desired stability is not attained, even in the case of spirals comprising a high pass distance, in the case of which the stretch wrap film runs across the upper edges of the load.

Methods are furthermore known, in the case of which the load that is to be packaged, is moved through a film curtain and this film curtain is welded together under stress or is welded together in a stress-free manner after passing through, wherein the film is subsequently shrunk by using heat. The loads that are packaged in this manner, leave much to be desired in view of splash water impermeability, in particular on their upper wall. In the case of this method, the entire film must encompass a sufficient thickness as well, so that a sufficient reinforcement is attained at highly stressed locations.

Contrary thereto, the invention is based on the technical object of specifying an apparatus of the above-mentioned type, in the case of which the packaging can be carried out with the smallest possible expenditure of material or film, respectively, in a simple manner in response to a functionally reliable stabilization of the load and with which the load can additionally be covered in a splash water-impermeable manner, in particular with reference to the upper wall. In addition, the packaging is to encompass an optically satisfactory appearance and the film is to be imprintable in a simple and informal manner, for example for advertising purposes. The invention is furthermore based on the technical object of specifying a corresponding method of packaging a load with film.

To solve the technical problems, the invention initially teaches an apparatus for packaging a load with film, wherein at least a film supply is available, from which the film can be fed, wherein the apparatus encompasses a first wrapping device by means of which a first film curtain or a first vertical film curtain, respectively, is formed from the fed film and wherein the first film curtain can be attached to all side walls or to all vertical side walls, respectively, of the load, wherein the first wrapping device encompasses a folding device by means of which a film section of the film, which is fed from the film supply, can be folded such that, after wrapping the load with the first film curtain, the film is attached to the side walls in the lower region of the side walls or of the vertical side walls, respectively, of the load in a double-layer manner according to the width of the folded film section, wherein the apparatus further encompasses a second wrapping device by means of which a second film curtain or a second vertical film curtain, respectively, can be embodied from fed film and wherein this second film curtain can be attached to the upper wall, to two side walls or to two vertical side walls, respectively, and to the bottom wall of the load by means of the second wrapping device.

As part of the invention, film refers in particular to a plastic film. According to a preferred embodiment, which will be explained below, a prestretched film is used in response to the wrapping of the load by means of the first wrapping device and/or in response to the wrapping of the load by means of the second wrapping device. As part of the invention, a shrink film, stretch wrap film or spiral stretch film, respectively, or hood stretch film is used in response to the wrapping of the load by means of the first wrapping device and/or in response to the wrapping of the load by means of the second wrapping device. In the context of the invention, load refers in particular to a stack of goods that rests on a pallet. Advantageously, the load, which is to be packaged by means of the apparatus according to the invention, is embodied in a rectangular-shaped manner and encompasses four vertical side walls.

The description "first" wrapping device and "second" wrapping device is not to determine an order of the wrapping according to the invention. As part of the invention, a wrapping can on principle also first take place by means of the second wrapping device and then a wrapping can take place by means of the first wrapping device. However, the reverse wrapping sequence is highly preferred in the context of the invention, in the case of which a wrapping first takes place by means of the first wrapping device and a wrapping subsequently takes place by means of the second wrapping device.

A suggested embodiment of the invention is characterized in that a film supply for the formation of the first film curtain by means of the first wrapping device encompasses at least two film rolls comprising film roll axles that are arranged horizontally or substantially horizontally, respectively. Advantageously, the horizontal film roll axles are thereby arranged parallel or substantially parallel, respectively, to the transport direction of the loads. As part of the invention, the film webs, which are—preferably horizontally—fed by said film rolls, are guided via deflecting elements, wherein the deflecting elements are embodied with the provision that a vertical orientation of the film webs or of the first film curtain formed therefrom, respectively, results. It is advisable for the film rolls of the first wrapping device to be arranged laterally next to the transport device or laterally next to a conveyor, respectively, for the loads, and for the film roll axles of these film rolls to advantageously be oriented parallel or substantially parallel, respectively, to the transport direction of the loads. Here and subsequently, film roll refers in particular to an aggregate of winding sleeve and film wrap or film coil, respectively, accommodated thereon. Advantageously, the film can be removed or unwound, respectively, from such a film roll as a flat film web.

Preferably, a combination of deflecting elements, which are arranged at right angles to the longitudinal film direction and diagonally to the longitudinal film direction, is used as deflecting elements for transferring the film webs into the vertical orientation. Deflecting elements are thereby advantageously rolls, rollers and/or rails. Such a deflection of a film in a vertical orientation is known from EP 1 029 786 (U.S. Pat. No. 6,474,051) or from EP 1 174 343 (U.S. Pat. No. 6,532,719), for example. Incidentally, as part of the invention, the afore-mentioned film rolls and deflecting elements are components of the first wrapping device.

As suggested, a folding element of the folding device is connected downstream from each of the two film rolls of the first wrapping device in feed direction of the film web. Preferably, this folding element is in each case connected upstream of the deflecting elements for the vertical deflection of the film web. Incidentally, as part of the invention, said folding device or the folding element, respectively, are components of the first wrapping device. According to an advantageous embodiment, the film web fed by each of the two film rolls first passes a film-storage device, then the folding element and subsequently the deflecting elements for transferring into the vertical orientation.

A preferred embodiment alternative of the invention is characterized in that the folding device or a folding element, respectively, of the folding device, is designed with the provision that the width b of the folded film section is 10 to 75%, as suggested 15 to 50%, preferably 20 to 40% and more preferably 25 to 38% of the height h of the side walls or of the vertical side walls, respectively, of the load. Advantageously, a continuous folding takes place across the entire length of the fed film webs. As part of the invention, the folded film section or the double-layer film resulting therefrom, respectively, after being attached to the load, are attached to the lower region, preferably the lower half, more preferably the lower third of the side wall or the vertical sides walls, respectively, of the load. As suggested, the folded film section covers the lower 10 to 75%, preferably the lower 15 to 50%, advantageously the lower 20 to 40 k and more preferably the lower 25 to 38% of the height h of the side walls or of the vertical side walls, respectively, of the load. In the case of loads consisting of palletized beverage packages, which are arranged on a pallet in layers, the lower three layers, for example, are secured by means of a film section that is folded all around. As part of the invention, the width of the folded film section can be adjusted. As part of the invention, the folded film section revolves across the periphery of the load after attaching the film curtain to the load. As suggested, the folding of the film section is carried out with the provision that, after attaching the film curtain to the load, the folded film section is attached to the load on the inner side and is covered by the remaining film curtain on the outer side. Then, the film section is thus folded toward the inner side of the film curtain. The invention is based on the knowledge that a highly effective stabilization is possible in the lower region of the load with the help of the folded film section. Due to this specifically effective stabilization possibility, it is not necessary for the film web to encompass a relatively large thickness across its entire length, Instead, film material can be saved as compared to measures that are known from the state of the art.

A particularly preferred embodiment of the invention is characterized in that the first wrapping device encompasses a prestretcher, by means of which the film web fed by a film roll or by means of which the film webs fed by the two film rolls, respectively, are in each case prestretched in feed direction or in their longitudinal direction, respectively. Advantageously, a prestretcher comprises a front and a rear roll arrangement or corresponding roll pairs, respectively, and the speed of the rolls can preferably be adjusted, so that the prestretching of the film results. In response to the prestretching, in particular the length of the film web is increased and the thickness of the film webs is reduced, wherein the thickness is preferably not reduced in proportion to the increase of the length. Advantageously, the film webs are thus nor or barely weakened, respectively, in response to the prestretching. The prestretched film then attaches to the load under the impact of elastic reset forces. The invention is based on the knowledge that the film, which is prestretched according to the invention, is characterized by good printability.

As part of the invention, the ends of the film webs, which are fed to the first wrapping device by the two film rolls, are welded, so that the first vertical film curtain is created. The first vertical film curtain is then attached to the vertical side walls of the load. As part of the invention, the apparatus according to the invention furthermore encompasses at least one transport device, in particular at least one conveyor, by means of which the load, which is to be packaged, can be fed to the vertical film curtain. Advantageously, the load is moved against the vertical film curtain by means of the transport device or by means of the conveyor, respectively, whereby a (first) weld seam preferably is attached to the front side of the load. As suggested, the preferably prestretched film attaches to the vertical side walls of the load in response to the further transport of the load. As part of the invention, the first wrapping device encompasses a welder and that two halves or parts, respectively, of the first vertical film curtain that can be brought into contact with one another, can be welded to one another by means of the welder in the course of the attaching of the vertical film curtain to the vertical side walls of the load, so that the vertical film curtain or the film, respectively, then completely surrounds the load on the vertical side walls. Advantageously, at least one vertical weld seam, which, as suggested, extends across the height of the load or substantially across the height of the load, respectively, is embodied in response to the welding of the two halves or parts, respectively, of the first vertical film curtain. Advantageously, a vertical weld seam is arranged on the front vertical side wall and a vertical weld seam is arranged on the rear vertical side wall of the load after the attaching of the first vertical film curtain to the vertical side walls of the load.

A preferred embodiment of the invention is characterized in that the welder of the first wrapping device is equipped to create two parallel vertical weld seams and that provision is preferably made for a cutting device by means of which the vertical film curtain can be severed between the two weld seams, so that one weld seam remains on the vertical film curtain that attaches across the periphery of the load, and the other weld seam is arranged on a further vertical film curtain for wrapping the next load, Advantageously, the welder of the first wrapping device encompasses double welding bars, by means of which the two parallel vertical weld seams are preferably created.

An alternative embodiment of the invention is characterized in that provision is made for a stabilizer to which the film curtain can be attached prior to the attaching to the load under the provision that the film curtain, which is attached to the stabilizer and which has been welded completely, surrounds the load and that the film curtain can be attached to the load after the removal of the stabilizer. As suggested, the stabilizer encompasses four vertical bars that are assigned to the four corners of a load, and which are initially arranged at a distance to the corners of the load. After attaching the film curtain to the vertical bars and after welding the film curtain, the vertical bars advantageously move past the load in transport direction or opposite the transport direction, respectively, of the loads, so that the film curtain loops around the corners of the load. Subsequently, the vertical bars are removed vertically—preferably upward—so that the film curtain attaches to the load under the impact of elastic reset forces. This embodiment is suitable in particular for light and sensitive loads or stacks of products, respectively, in the case of which a direct attaching of the film curtain under the impact of considerable elastic reset forces would lead to damages to the load.

The wrapping of a load by means of the second wrapping device will be described below. As suggested, a film supply for forming the second vertical film curtain encompasses at least two film rolls comprising film roll axles that are arranged horizontally or substantially horizontally, respectively. Advantageously, the film webs fed by the film roll axles—preferably horizontally—are guided across deflecting elements, with said deflecting elements being embodied and arranged with the provision that the film web, which is removed from the one film roll is fed from the top or vertically from the top, respectively, for wrapping the load and that the film web, which is removed from the other film roll, is fed from below or vertically from below, respectively, for wrapping the load. As suggested, the film web that is fed from below or vertically from below, respectively, is thereby guided through a gap in the transport device for the load. As part of the invention, the film webs, which are fed in this manner, are welded to one another to form the second film curtain. Advantageously, the film roll axles of the two film rolls are arranged horizontally or substantially horizontally, respectively, in transport direction of the loads. Incidentally, as part of the invention, the afore-mentioned film rolls and/or deflecting elements are components of the second wrapping device.

It is advisable for the second wrapping device to encompass a prestretcher, by means of which the film web fed by a film roll or the film webs fed by the film rolls, respectively, are prestretched in feed direction or in their longitudinal direction, respectively. Advantageously, a prestretcher of the second wrapping device comprises roll arrangements or roll pairs, respectively, and the speed of the rolls is adjusted for prestretching the film webs. In response to this prestretching, in particular the length of the film webs is increased and the thickness of the film webs is reduced, wherein the thickness is preferably not reduced in proportion to the increase of the length. As suggested, the film webs are thus not or barely weakened in response to this prestretching.

As part of the invention, the second wrapping device encompasses a (second) welder, by means of which the film web fed from the top and the film web fed from below can be welded to one another. In particular, as part of the invention, the second wrapping device encompasses a (second) welder and, in the course of the attaching of the second film curtain to the load, two halves or parts, respectively, of the second film curtain can be welded by means of the welder by forming at. least one horizontal weld seam, so that this second film curtain surrounds the load at its front vertical side wall, at its upper wall and bottom wall, as well as at its rear vertical side wall. Advantageously, a horizontal or substantially horizontal weld seam, respectively, is arranged on the front vertical side wall and a further horizontal or substantially horizontal weld seam, respectively, is arranged on the rear vertical side wall of the load after wrapping the load with the second film curtain. Advantageously, the (second) welder of the second wrapping device is equipped to create two horizontal or parallel horizontal weld seams, respectively, which are arranged next to one another, and provision is preferably made for a (second) cutting device by means of which the second film curtain can be severed between the two horizontal weld seams that are arranged next to one another. In so doing, a horizontal weld seam remains on the second film curtain, which is attached to the load, and the other horizontal weld seam remains on a second film curtain for wrapping the next load. Preferably, the second welder of the second wrapping device encompasses double welding bars.

An alternative embodiment of the invention is characterized in that provision is made for a (second) stabilizer, to which the second film curtain can be attached prior to the attaching to the load with the provision that the second film curtain, which is attached to the (second) stabilizer and which has been welded completely, surrounds the load and wherein, after removal of the stabilizer, the second film curtain can be attached to the load. It is advisable for the (second) stabilizer to encompass four horizontal bars, wherein two of these horizontal bars are assigned to the corner on the upper wall and two of these horizontal bars are assigned to the corners on the bottom side of the load. Preferably, the four horizontal bars are initially arranged at a distance from the corners of the load and the second film curtain is attached and welded to these horizontal bars. Advantageously, the four horizontal bars subsequently move upward or downward, respectively, along the front and along the rear vertical side wall, so that the second film curtain attaches to the upper and to the lower corners of the load. Through this, the vertical bars are removed in horizontal direction, so that the second film curtain can attach to the load under the impact of elastic reset forces. For the reasons already set out above, this embodiment is also suitable in particular for light and sensitive loads or stacks of goods, respectively.

As suggested, the second wrapping device is equipped with a cutting device by means of which at least the film part, which is to be attached to the bottom wall of the load, can be severed in the course of the attaching of the second film curtain to the bottom wall of the load, so that the film strips, which are formed by the severing by means of the cutting device, can be attached to the pallet bottom wall at least substantially between pallet runners or pallet bases, respectively of a pallet. As part of the invention, the cutting device is arranged underneath the load or underneath the transport device, respectively, for the load. Advantageously, a severing of the fed film web is carried out longitudinally or in feed direction, respectively, of the film web. The length of the severing preferably corresponds at least to the length of the pallet bottom wall. When a pallet comprising a central pallet runner and two lateral pallet runners is chosen according to an embodiment, the severing is advantageously carried out as a central cut in the film web, thus resulting in two film strips, each of which are attached to the bottom wall of the pallet between a lateral pallet runner and the central pallet runner.

According to a preferred embodiment, the thickness of the first film curtain is incidentally larger than the thickness of the second film curtain. In other words, the film used in the first wrapping device is thus thicker than the film used in the second wrapping device.

The invention is based on the knowledge that a highly effective and functionally reliably packaging of a load with a film is possible by means of the apparatus according to the invention and by means of the method according to the invention, wherein an optimal load stabilization can be attained and work can nonetheless be performed in a highly material-saving manner. The load can be supported effectively mainly at critical locations, without the need to use a relatively thick film in a material-intensive manner. In addition, a sufficient splash water impermeability of the packaging is also attained by means of the apparatus according to the invention or by means of the method according to the invention, respectively, in response to a high load stability. A highly effective splash water protection is realized in particular in the upper region of the load. It should also be emphasized that the packaging created according to the invention provides for an optically satisfactory appearance. In addition, the film attached by means of the apparatus according to the invention or by means of the method according to the invention, respectively, can be imprinted in a simple and informal manner, for example for advertising purposes.

BRIEF DESCRIPTION OF THE DRAWING

The invention will be defined in more detail below by means of a drawing that illustrates an exemplary embodiment. In a schematic illustration.

SPECIFIC DESCRIPTION OF THE INVENTION

Figure 1:
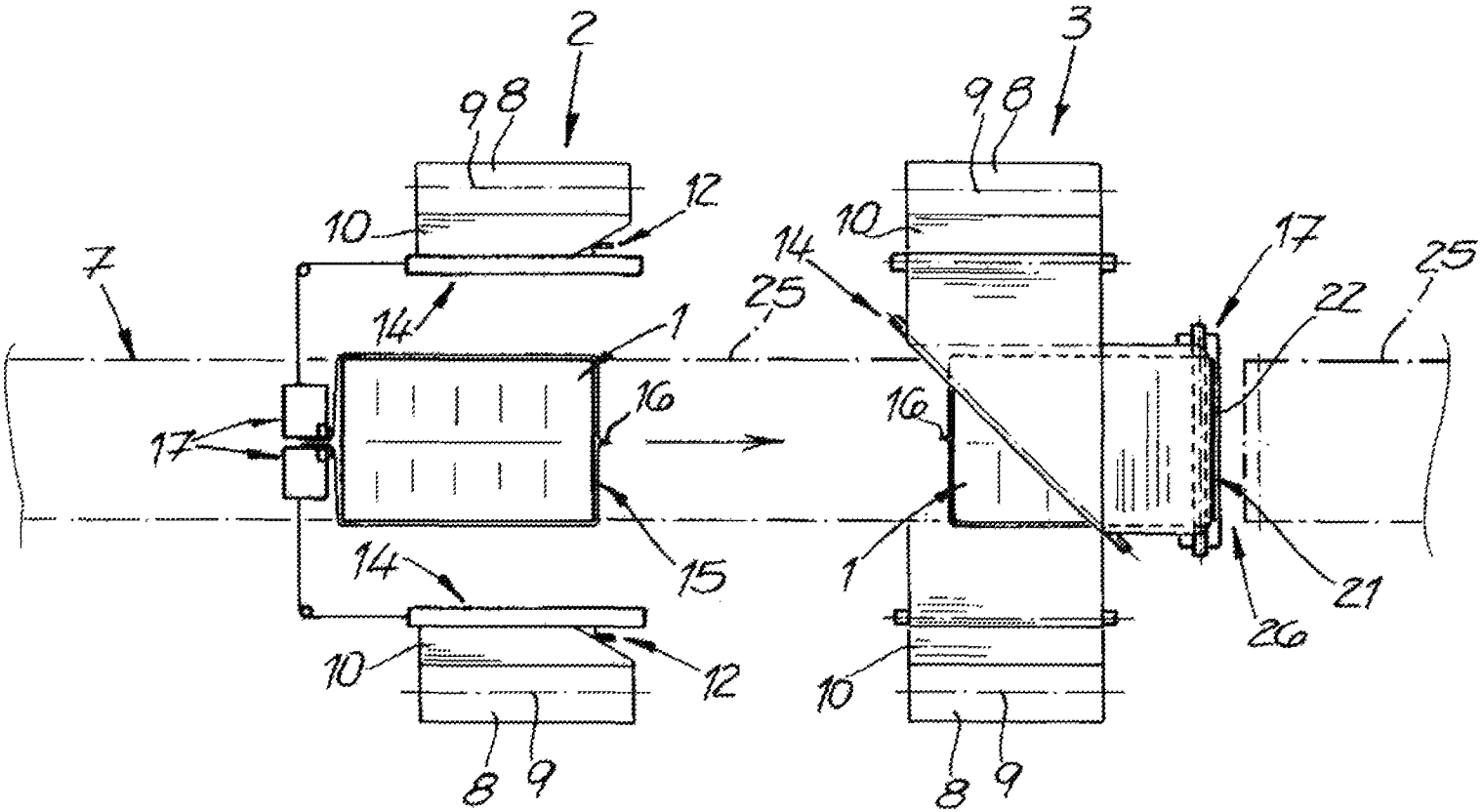
FIG. 1 shows a top view onto an apparatus according to the invention comprising a first and second wrapping device.
Figure 2:
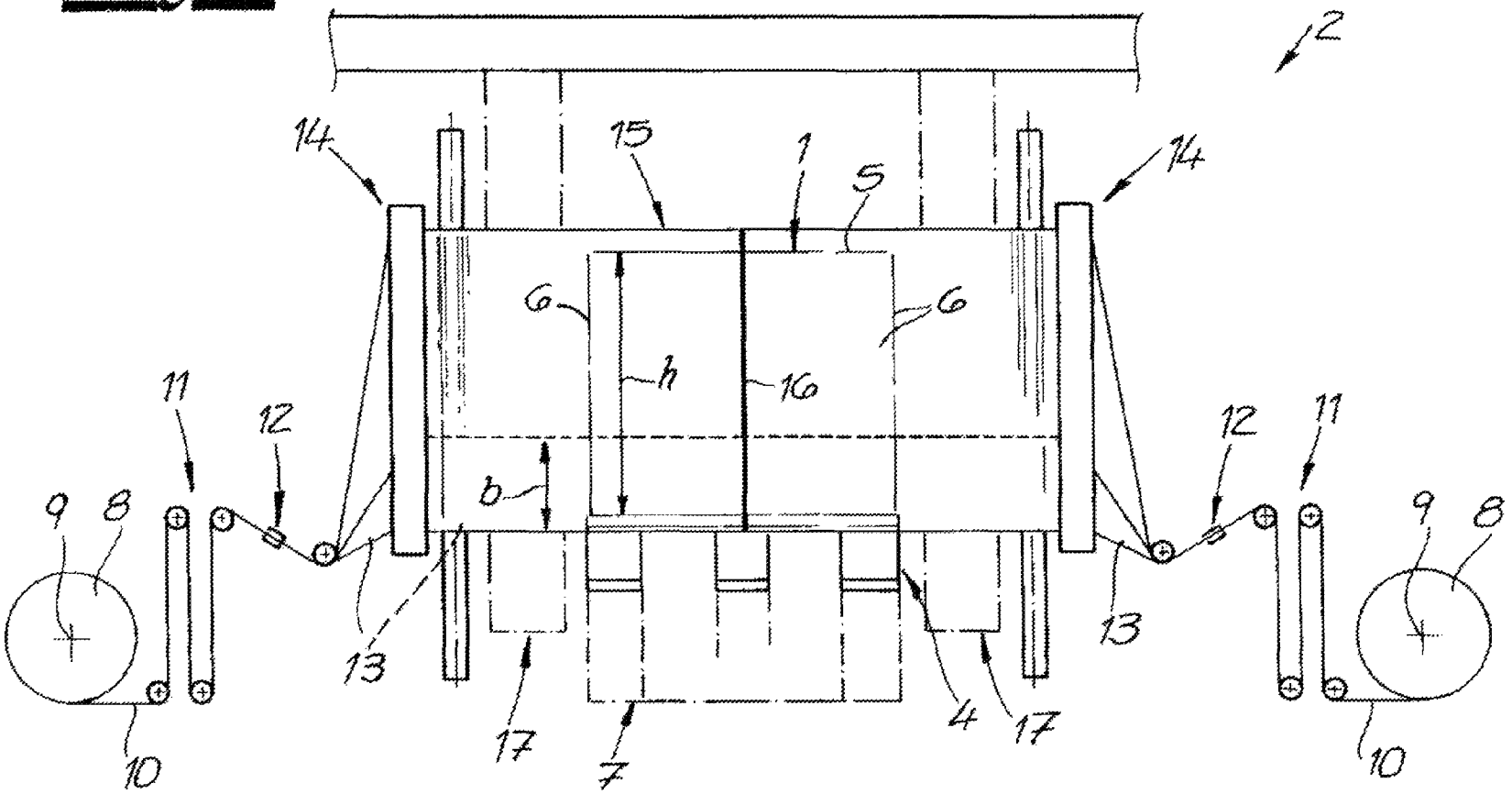
FIG. 2 shows a front view of the first wrapping device.
Figure 3:
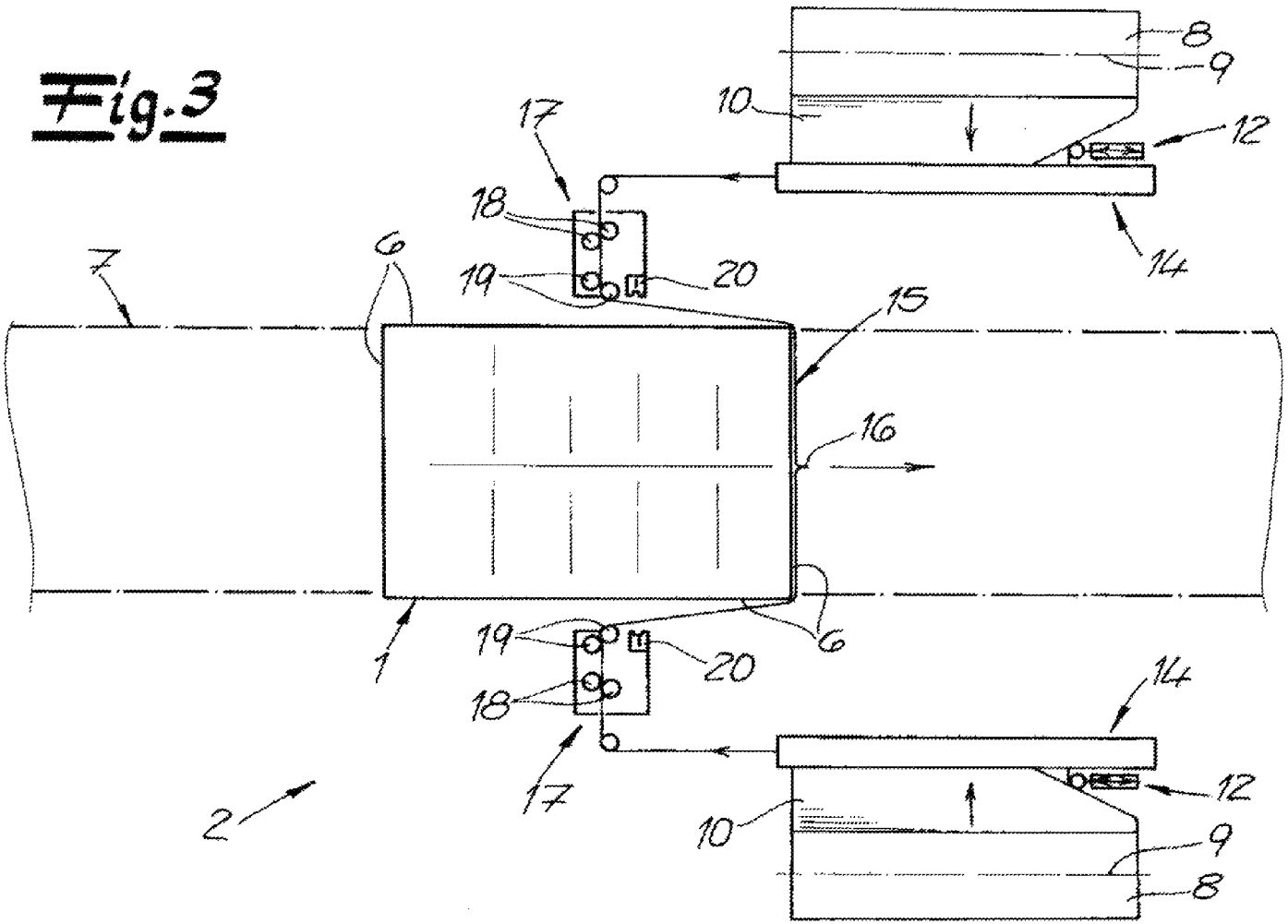
FIG. 3 shows a top view onto the first wrapping device.
Figure 4:
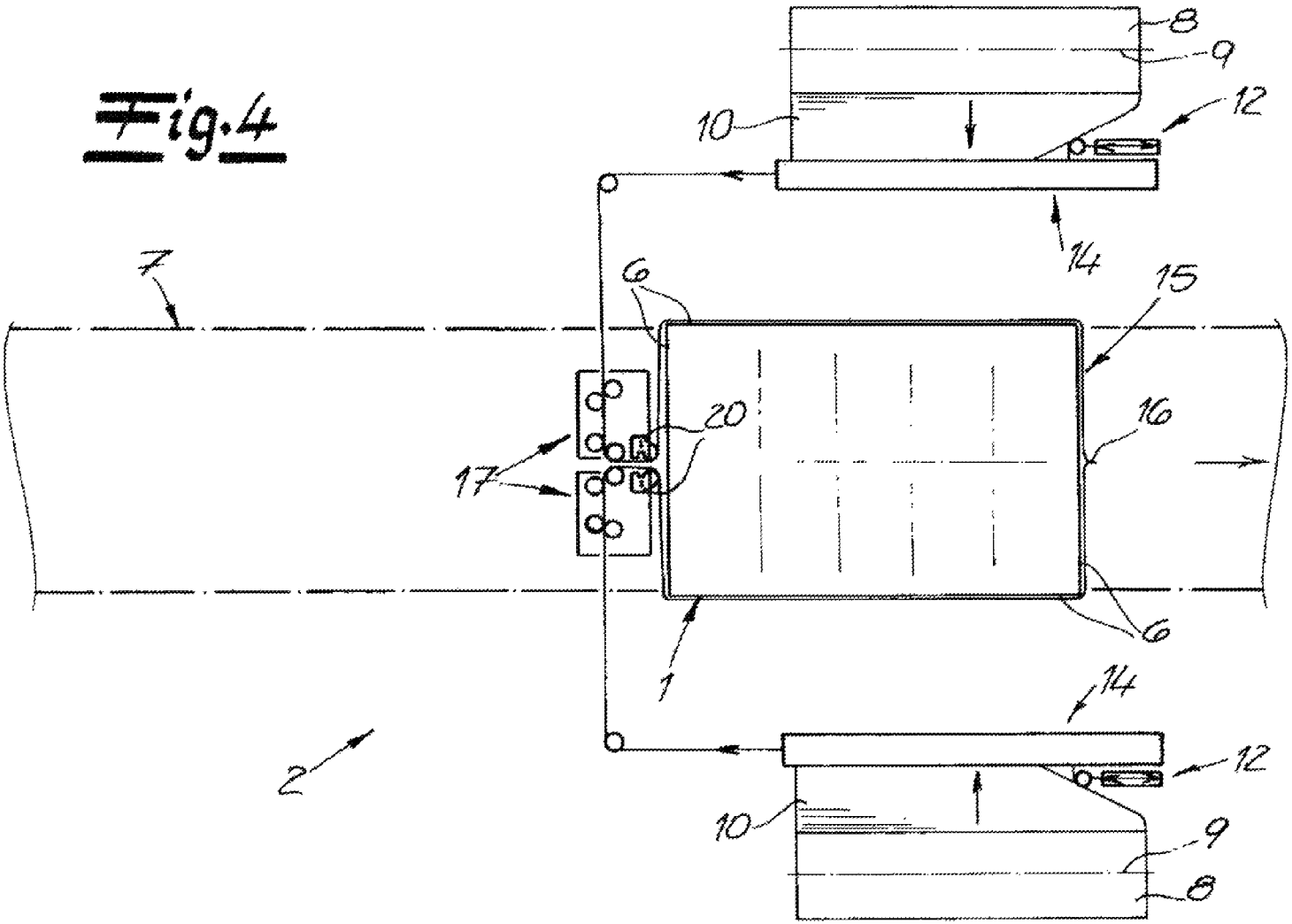
FIG. 4 shows the subject matter according to FIG. 3 in a further functional position.
Figure 5:
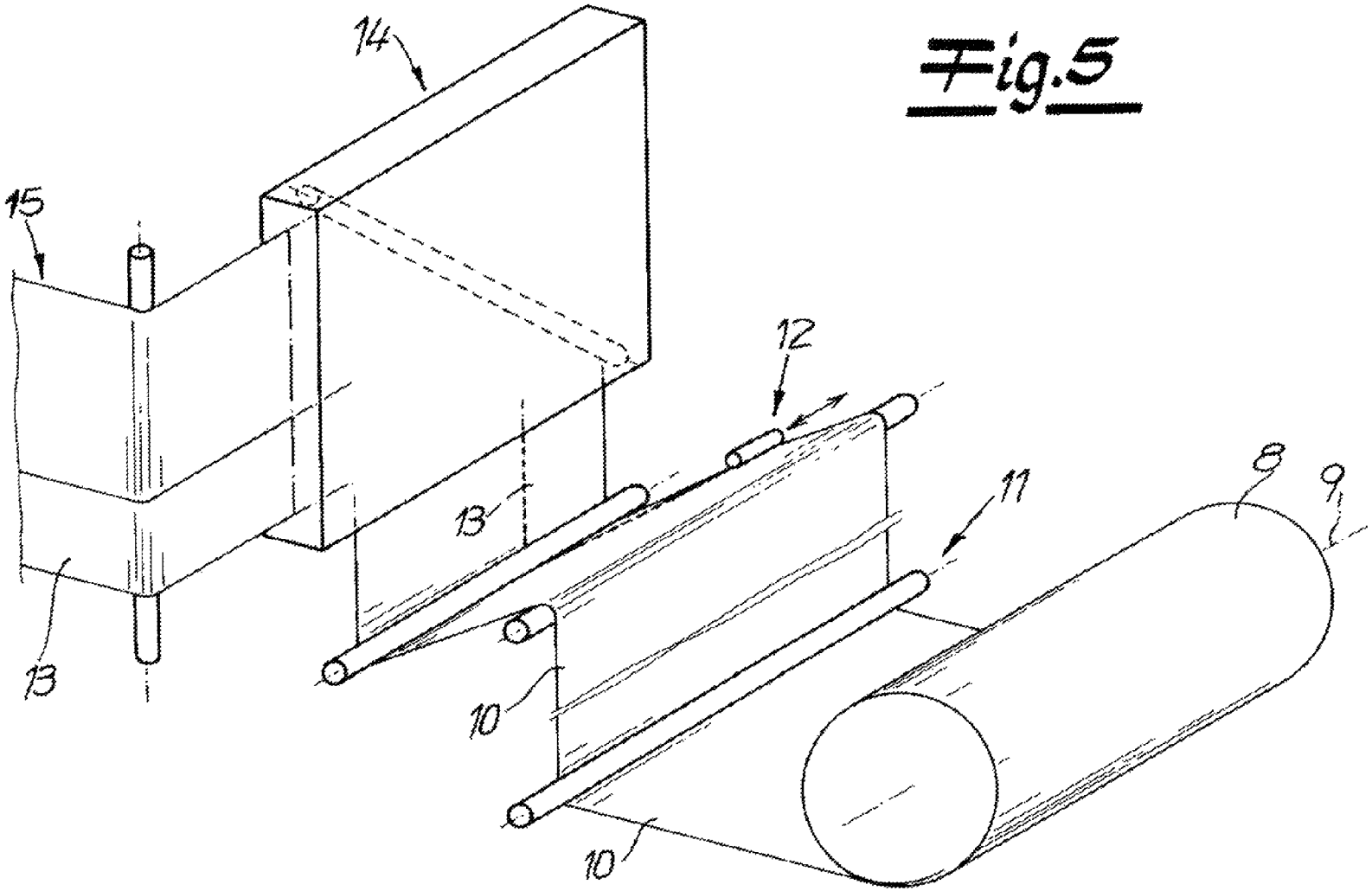
FIG. 5 shows a perspective section of the first wrapping device.

The figures show an apparatus for packaging a load 1 with plastic film. The apparatus according to the invention encompasses a first wrapping device 2 as well as a second wrapping device 3. Loads 1 can in each case be wrapped with plastic film by means of both wrapping devices 2, 3. In the exemplary embodiment according to the figures, a load 1 consists of a pallet 4 and of a stack of goods 5 that is arranged on the pallet 4. A load 1 or the stack of goods 5, respectively, which is arranged on the pallet 4, is embodied in a rectangular-shaped manner in the exemplary embodiment and encompasses four vertical side walls 6. Preferably and in the exemplary embodiment, the loads 1 are first conveyed into the first wrapping device 2 and then into the second wrapping device 3 by means of a transport device 7 (FIG. 1).

First of all, the first wrapping device 2, which is illustrated in FIGS. 2 to 6, will be described below. The first wrapping device 2 encompasses two film rolls 8 comprising film roll axles 9 that are arranged horizontally and in transport direction of the loads 1. Film webs 10, which are in each case initially guided through a film-storage device 11 in the exemplary embodiment, are removed from the film rolls 8. Preferably and in the exemplary embodiment, one folding element 12, by means of which a film section 13, which extends along each film web 10, is folded, is in each case connected downstream from the film-storage devices 11. Such a folding element 12 will be described below in context with FIG. 6. Due to the folding, each film web is embodied in a double-layer manner in the region of the folded film section 13. In the exemplary embodiment, the width b of each folded film section 13 may be one third of the height h of the vertical side walls 6 of the load 1. In the attached state of the film, the folded film section 13 or the corresponding double-layer embodiment of the film, respectively, is arranged in the lower third of the stack of goods 5, for example, In the exemplary embodiment, deflecting elements 14, by means of which the horizontally fed film webs 10 can be transferred into a vertical orientation, are connected downstream from the folding elements 12 in feed direction of the film webs 10. Such a deflection by means of deflecting elements 14 is schematically illustrated in particular in FIG. 5. The vertical film curtain 15 then results from the vertically oriented film webs 10, in that the two film webs 10 are connected or welded to one another, respectively, by means of a vertical weld seam 16.

Incidentally, a prestretcher 17, by means of which the fed vertically oriented film webs 10 can be prestretched prior to being attached to the load 1, is connected downstream from the deflecting elements 14 on each side of the load 1. In the exemplary embodiment, the prestretchers 17 encompass in each case a front roll pair 18 and a rear roll pair 19. By setting the rotational speed of the rear roll pair 19 to be higher than the rotational speed of the front roll pair 18, a corresponding degree of prestretch of the film webs 10 can be attained. The vertical film curtain 15 formed from the film webs 10 is then attached to all four vertical side walls 6 of the load 1. This can be seen in particular from a comparative view of FIGS. 3 and 4. It can be gathered from FIG. 4 that the vertical film curtain 15 is attached to the rear vertical side wall 6 of the load 1 by pushing together the double welding bars 20 that form a welder. With the help of the double welding bars 20, two parallel vertical weld seams 16, which are arranged next to one another, are then formed. The film curtain 15 is subsequently severed between the two parallel weld seams 16 by means of a cutting device, which is not illustrated in detail, so that a weld seam remains on the vertical film curtain 15, which is attached across the periphery of the load 1, and the other weld seam 16 contributes to the formation of a further vertical film curtain 15 for wrapping the next load 1. Film or the vertical film curtain 15, respectively, is thus attached to all four vertical side walls 6 of the load 1 by means of the first wrapping device 2, wherein the film then advantageously extends across the entire height h or substantially across the entire height h, respectively, of the vertical side walls 6 of the load 1.

As already defined, the folded film section 13 is in particular located in the lower third of the load 1 or in the lower third of the stack of goods 5, respectively. A particularly effective securing of the load can be attained in the lower region of the load 1 by means of this folded film section 13. As suggested, the film section 13 is incidentally folded toward the inner side of the film curtain 15, so that the folded film section 13 is attached to the load 1 and is covered by the remaining film curtain 15.

Figure 6:
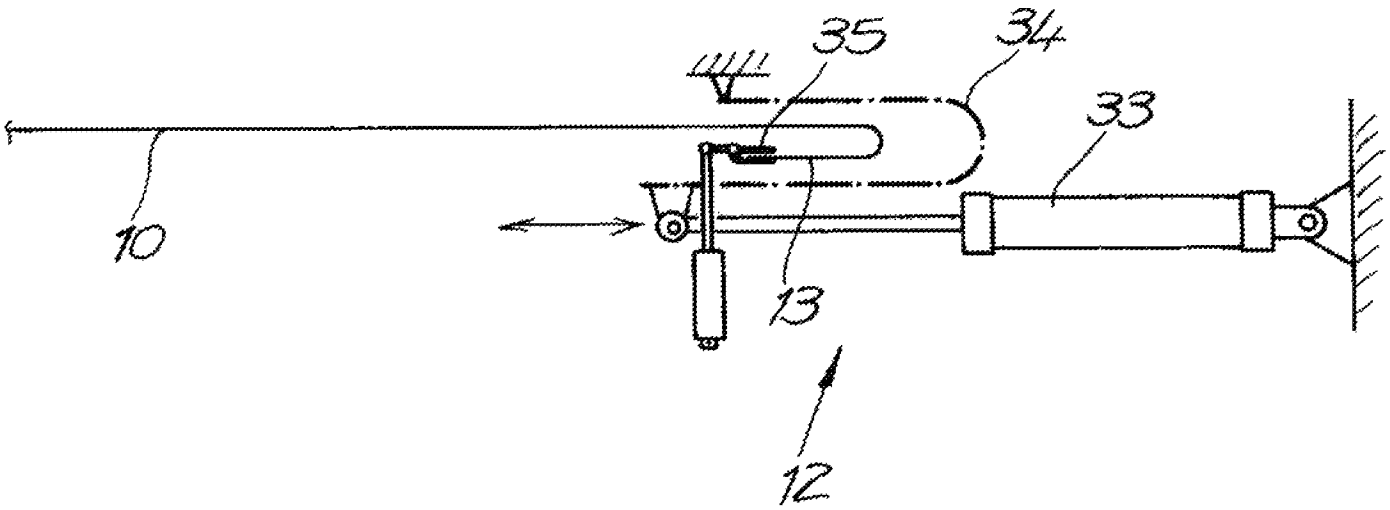
FIG. 6 shows a view of a folding element of the first wrapping device.

FIG. 6 shows a preferred embodiment of a folding element 12 for the first wrapping device 2. Advantageously, the folding element 12 encompasses an extendable linear element 33, which is connected to an articulated element, preferably to a deflecting toggle chain 34. The articulated element or the deflecting toggle chain 34, respectively, is equipped with a clamping apparatus 35, by means of which the film edge of the film web 10 is clamped for a folding. In response to a folding of a film section 13, the linear element 33 extends, so that the deflecting toggle chain 34 is guided along with the film edge, which is clamped by means of the clamping apparatus 35, and the film section 13 is folded in this manner. When the film web 10 is fed for wrapping the load 1, the clamping apparatus 35 remains open. Advantageously, the linear element 33 can be extended in different positions, so that the width of the film section 13 can be adjusted through this.

Figure 7:
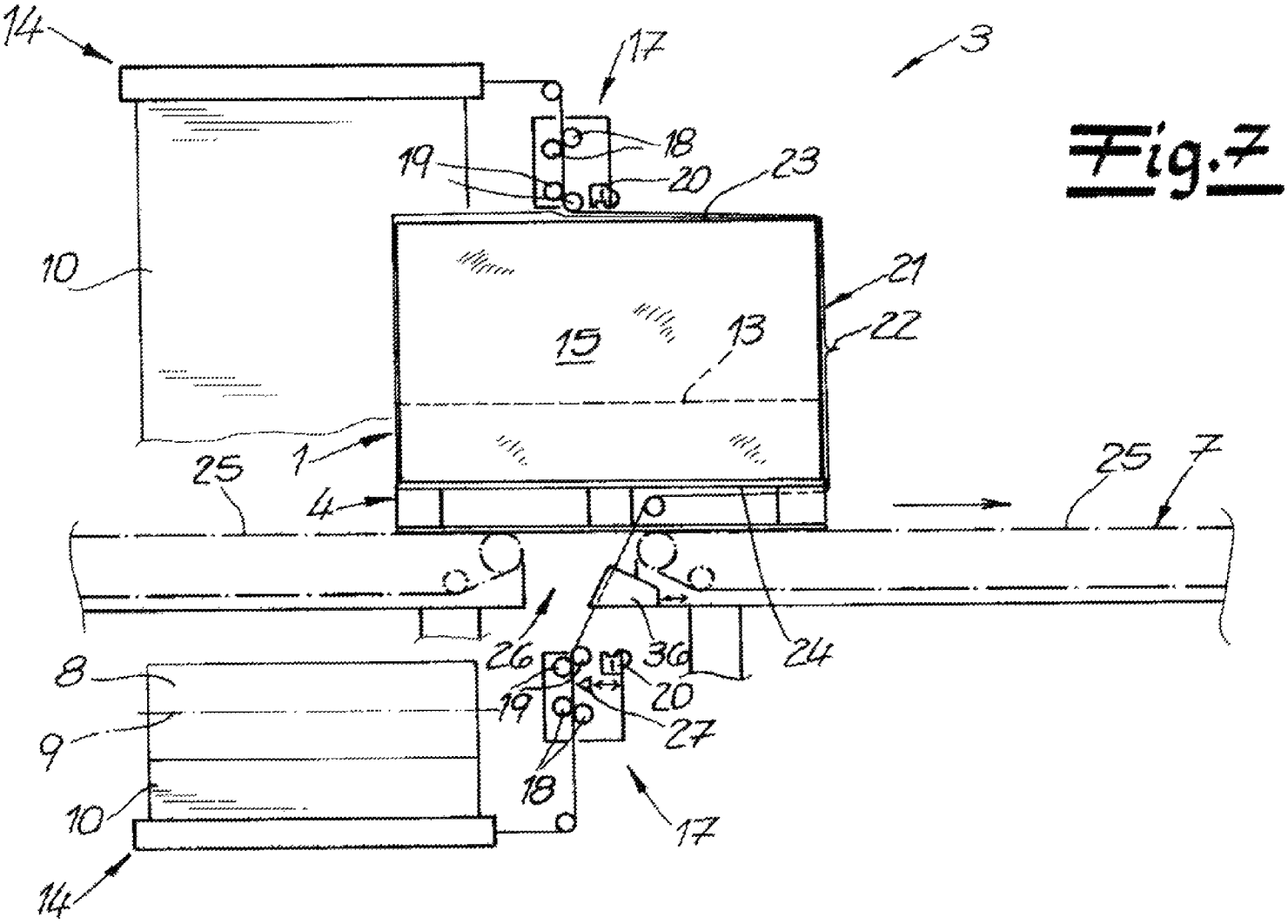
FIG. 7 shows a side view of the second wrapping device.
Figure 8:
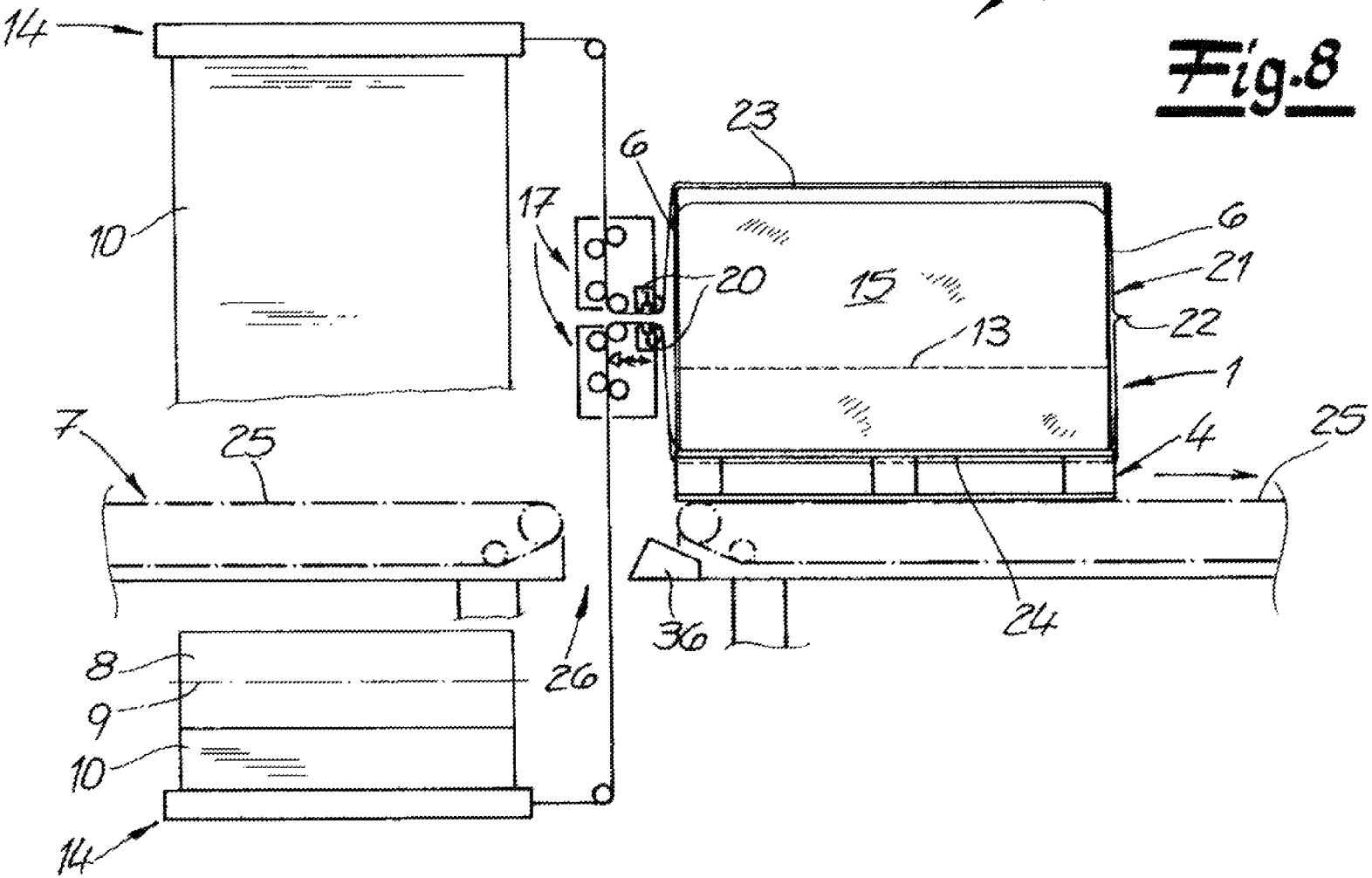
FIG. 8 shows the subject matter according to FIG. 7 in a further functional position.
Figure 9:
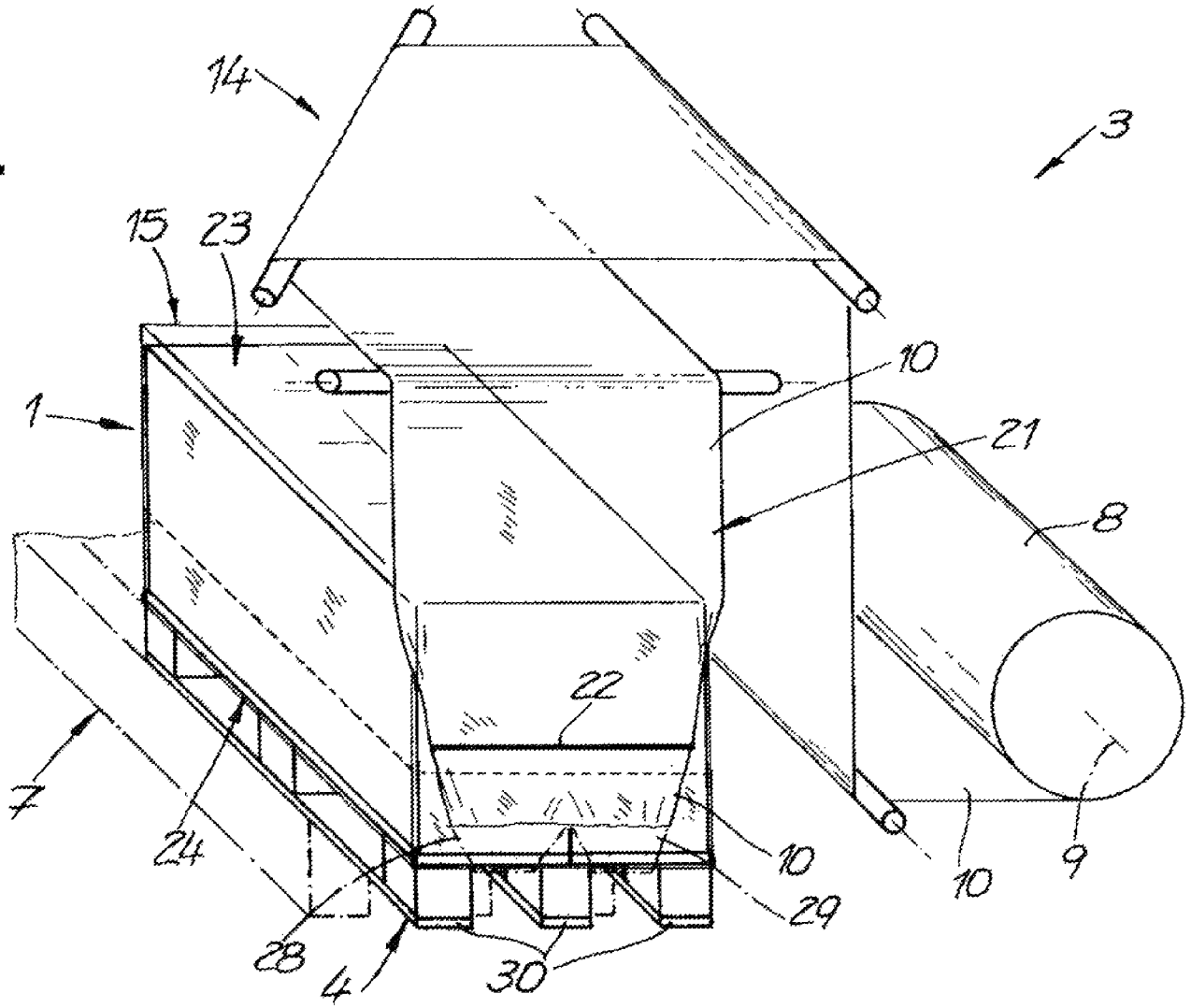
FIG. 9 shows a perspective section of the second wrapping device.

The wrapping by means of the second wrapping device 3 will be described below. This second wrapping device 3 is illustrated in particular in FIGS. 7 to 9. The second wrapping device 3 also encompasses two film rolls 8 comprising film roll axles 9 that are arranged horizontally and in transport direction of the loads 1. The film webs 10, which are removed from the film rolls 8, can in each case also be guided through a film-storage device 11 in a manner that is not illustrated in detail. In the case of the second wrapping device 3, the film webs 10 are advantageously also additionally guided via deflecting elements 14 resulting in a vertical orientation of the film webs 10 or of the second film curtain 21 formed therefrom, respectively. Such a deflection by means of deflecting elements 14 is illustrated in FIG. 9. In the second wrapping device 3, the film web 10, which is is removed from the one film roll 8, is fed vertically from the top for wrapping the load 1. The film web 10, which is removed from the other film roll 8, is fed vertically from below. Preferably, prestretchers 17 are also connected downstream from the deflecting elements 14 of the second wrapping device 3. Advantageously, the prestretchers 17 also encompass a front roll pair 18 and a rear roll pair 19 and operate as described with reference to the first wrapping device 2. The film, which is prestretched in this manner, is then attached to the load 1. By welding the film web 10 fed from the top to the film web 10 fed from below comprising a horizontal weld seam 22, the second vertical film curtain 21 is obtained, which is initially attached to the front vertical side wall 6 of the load 1 and which is incidentally attached to the upper wall 23 and to the bottom wall 24 of the load 1 as well as to the rear vertical side wall 6 of the load 1, This is shown in particular in a comparative view of FIGS. 7 and 8. It should be pointed out that the transport device 7, which is formed from conveyors 25, encompasses a gap 26, so that a film web 10 can be fed vertically from below.

Incidentally, the second wrapping device 3 encompasses an unraveling apparatus 27, by means of which at least the film part, which is to be attached to the bottom wall 24 of the load 1, can be unraveled in the course of the attachment of the second film curtain 21 to the bottom wall 24 of the load 1, so that the film strip 28, 29, which are formed by the unraveling, can be attached to the pallet bottom wall between pallet runners 30 of the pallet 4 that are oriented parallel to the transport direction of the load 1. This can be seen in particular in FIG. 10. Incidentally, a spreading apparatus 36 for a corresponding spreading of the film strips 28, 29, can be seen in FIGS. 7 and 8. FIG. 8 shows that the second film curtain 21 can be attached to the rear vertical side wall 8 of the load 1 by pushing together the double welding bars 20 of a second welder. The two halves of the film curtain 21 can be connected to the double welding bars 20 of the second welder by means of welding. Advantageously, two horizontal weld seams 22 are formed thereby and provision is made for a cutting device, which is not illustrated in detail, by means of which the film curtain 21 can be severed between the two parallel horizontal weld seams 22. A horizontal weld seam 22 thus remains on the second film curtain 21, which is attached to the load 1 and the other horizontal weld seam 22 remains on a further film curtain 21 for wrapping the next load 1.

Figure 10:
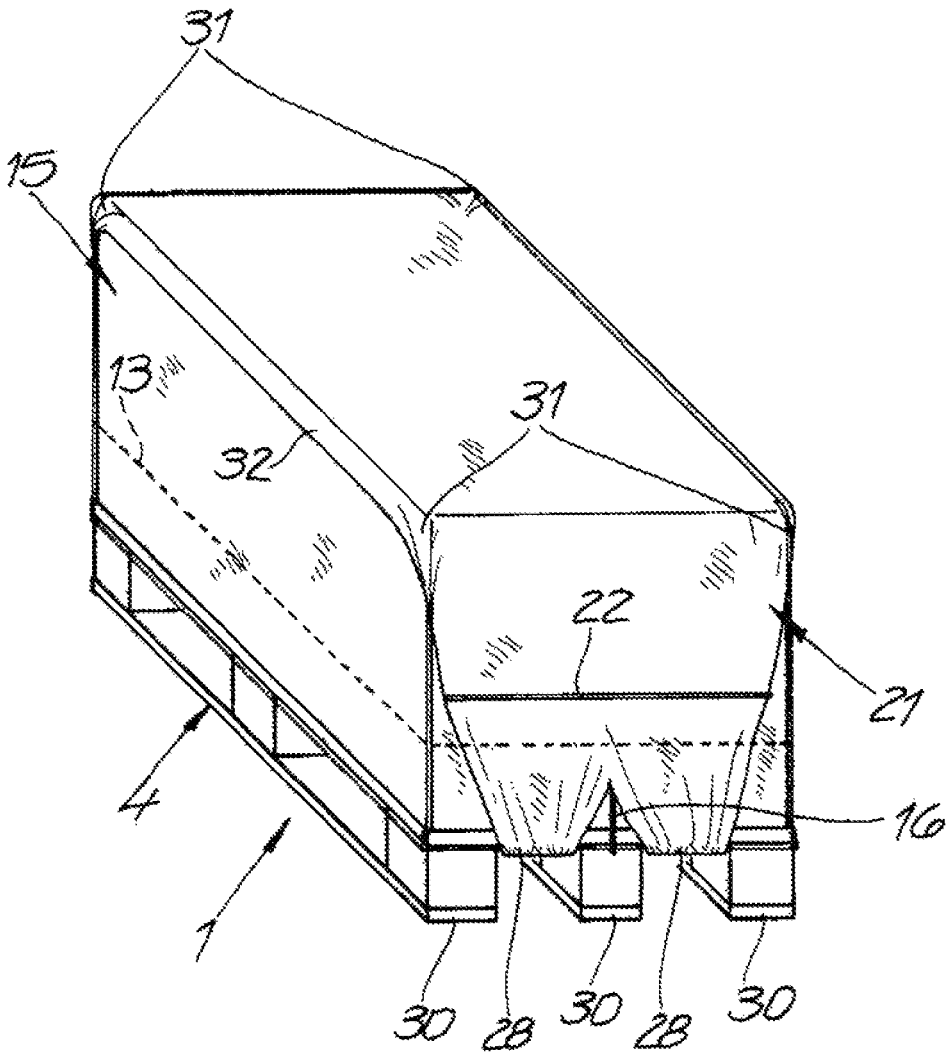
FIG. 10 shows a load that is packaged according to the invention.

Incidentally, it can be seen in FIG. 10 that, preferably and in the exemplary embodiment, the second film curtain 21 is attached to the load. 1 such that the upper corners 31 of the load 1 are covered by the second film curtain 21. A particularly effective splash water protection is attained for the stack of goods 5 in this manner. As needed, the longitudinal sections 32 placed on the upper wall of the load 1 or the narrow longitudinal sections 32 of the second film curtain 21, respectively, can be adhered and/or welded to the first film curtain 15 that is attached to the vertical side walls 6.

The invention claimed is:

1. An apparatus for packaging a load having an upper wall, a bottom wall, and side walls with film from a film supply from which the film can be fed, the apparatus comprising:

a first wrapping device that forms from the fed film a first film curtain that can be attached to all walls of the load;

a folding device in the first wrapping device that can fold a film section of the film fed from the film supply such that, after wrapping the load with the first film curtain, the film is attached to the side walls in a lower region of the side walls of the load in a double-layer manner according to the width of the folded film section; and a second wrapping device that forms from the fed film a second film curtain that the second wrapping device also attaches to the upper wall, to two side walls and to the bottom wall of the load.

2. The apparatus according to claim 1, wherein the film supply for forming the first film curtain has at least two film rolls having respective film roll axles that extend substantially horizontally, and the film webs fed by the film rolls are guided via deflecting elements, so that a vertical orientation of the film webs or of the first film curtain formed therefrom results.

3. The apparatus according to claim 2, wherein a respective folding element of a folding device is connected downstream from each film roll in a feed direction of the film web and the folding elements are each connected upstream of the respective deflecting elements for vertical deflection of the film web.

4. The apparatus according to claim 2, wherein the first wrapping device has a prestretcher that prestretches the film webs fed by the film rolls in their feed or longitudinal direction.

5. The apparatus according to claim 1, wherein the folding device operates such that a width b of the folded film section is 15 to 45% of the height h of the side walls of the load.

6. The apparatus according to claim 1, further comprising:

a stabilizer to which the first film curtain can be attached prior to the attachment to the load such that the first film curtain that is attached to the stabilizer surrounds the load and can be attached to the load after removing the stabilizer.

7. The apparatus according to claim 6, wherein the first wrapping device comprises a welder that can weld two halves or parts of the vertical film curtain while forming at least one weld seam and the first film curtain to the side walls of the load or to the stabilizer.

8. The apparatus according to claim 6, further comprising:

a second stabilizer to which the second film curtain can be attached prior to attachment to the load so that the second film curtain attached to the second stabilizer surrounds the load and can be attached to the load after removal of the second stabilizer.

9. The apparatus according to claim 1, wherein the film supply for the formation of the second film curtain has at least two film rolls having respective film roll axles that extend substantially horizontally, the film webs fed by the film rolls being guided by respective deflecting elements, so that the film web from one of the film rolls is fed vertically from above for wrapping the load and the film web from the other film roll is fed vertically from below.

10. The apparatus according to claim 9, wherein the second wrapping device has a prestretcher that prestretches the film webs fed by the film rolls in their feed or longitudinal direction.

11. The apparatus according to claim 1, wherein the second wrapping device has a welder that can weld two halves or parts of the second film curtain while forming at least one horizontal or substantially horizontal weld seam while attaching the second film curtain to the load.

12. The apparatus according to claim 1, wherein the second wrapping device has a cutting device that can sever at least the film part that is to be attached to the bottom wall of the load during attachment of the second film curtain to the bottom wall of the load, so that the film strips formed by the severing can be attached to a pallet bottom wall between pallet runners or bases of a pallet of the load.

* * * * *